US006558210B2

(12) United States Patent
Frasier

(10) Patent No.: US 6,558,210 B2
(45) Date of Patent: May 6, 2003

(54) DEVICE FOR PROPELLING A DIVER THROUGH A BODY OF WATER USING PEDALING MOTION

(76) Inventor: Charles Consolvo Frasier, 5453 Bothe Ave., San Diego, CA (US) 92122

( * ) Notice: Subject to any disclaimer, the term of this patent is extended or adjusted under 35 U.S.C. 154(b) by 0 days.

(21) Appl. No.: 09/940,939

(22) Filed: Aug. 29, 2001

(65) Prior Publication Data

US 2003/0045182 A1 Mar. 6, 2003

(51) Int. Cl.[7] ..... B63H 1/36; B63H 16/02
(52) U.S. Cl. ..... 440/25; 440/14
(58) Field of Search ..... 114/315; 440/14, 440/21–32; 441/55; D12/306, 308

(56) References Cited

U.S. PATENT DOCUMENTS

| | | | | | |
|---|---|---|---|---|---|
| 1,918,185 | A | * | 7/1933 | Hofius | 440/32 |
| 3,111,109 | A | * | 11/1963 | Nicolaie | 440/31 |
| 3,211,126 | A | * | 10/1965 | Bowlus | 440/14 |
| 3,323,481 | A | | 6/1967 | Harvey | |
| 3,426,722 | A | * | 2/1969 | Dragich | 441/55 |
| 3,440,994 | A | * | 4/1969 | McGowan | 440/32 |
| 3,529,565 | A | * | 9/1970 | Iglesias | 441/55 |
| 3,768,431 | A | | 10/1973 | Picken | |
| 4,193,371 | A | * | 3/1980 | Baulard-Caugan | 440/21 |
| 4,345,903 | A | * | 8/1982 | Laser | 440/14 |
| 5,379,714 | A | * | 1/1995 | Lewis et al. | 114/315 |
| 5,401,196 | A | | 3/1995 | Triantafyllou | |
| 5,743,772 | A | * | 4/1998 | Assawah et al. | 440/31 |
| 6,033,276 | A | | 3/2000 | Han | |

* cited by examiner

*Primary Examiner*—S. Joseph Morano
*Assistant Examiner*—Andy Wright

(57) ABSTRACT

A diver lying prone in the water grasps the invention with his hands and pushes on pedals with his feet. The pedal motion is converted into propulsive force that moves the diver through the water. The diver is free to bend at his hip joints and bend and twist his spine to cause turns, dives and ascents in the water. The preferred embodiment of the propulsion means comprises a simple direct drive of an arm. As the diver operates the pedals the forward end of the arm pivots with respect to the device as the rearward end of the arm sweeps back and forth in the water. A fin is attached to the rearward end of the arm. The fin is fitted with a simple device for controlling the angle of attack of the fin with respect to the flow of water past it.

3 Claims, 5 Drawing Sheets

DEVICE FOR PROPELLING A DIVER THROUGH A BODY OF WATER USING PEDALING MOTION

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDEX

Not Applicable.

BACKGROUND OF THE INVENTION

1. Field of the Invention

This invention relates to devices wherein means are provided to propel a diver through a body of water with which he is in direct contact.

2. Description of the Prior Art

Several devices for propelling a diver through a body of water with which he is in direct contact are provided in prior art.

U.S. Pat. No. 3,323,481 to Harvey (1967) discloses a swimming appliance that is applied to a swimmer as a "pack" or a "ruck sack" using straps or a harness. Steerage by a swimmer is achieved by using the hands or feet as rudders or paddles. A motor drives a propeller or an impeller or a water jet to propel the swimmer through the water.

U.S. Pat. No. 3,768,431 to Picken (1973) discloses a manually operated underwater swimming aid for use in propelling a diver or swimmer below the surface of the water. The aid facilitates such propulsion through oscillating motion imparted by the diver to a pair of resilient planar blades. The blades are anchored to an axial support. Handles are provided rearward of the support for gripping by the swimmer. Subsequent manual application of oscillating torque forces to the handles about the longitudinal axis of the aid flex the blades into a propeller configuration to pull the diver through the water.

U.S. Pat. No. 6,033,276 to Han (2000) discloses a personal water vehicle comprising a structure for supporting a person in a prone position above an upper surface of a body of water. A facility is for steering the supporting structure in the body of water using manual operation by the hands of the person. An assemblage is for propelling the supporting structure in the body of water, using peddle movement by the feet of the person A device for viewing, extends through the supporting structure so that the person can look into the body of water. Furthermore, the propelling assemblage comprises a swivel pedal assembly, pivotally mounted over the rearward end of the supporting structure at the tail fin assembly. A pair of toe clip foot hanger pedals are provided with each mounted on an opposite end of the swivel pedal assembly, to engage with one foot of the person. A propulsion gear box is carried in the tail fin assembly in conjunction with the steering gear unit. When the swivel pedal assembly is rocked forward and rearward by the peddle movement of the feet of the person engaging the toe clip foot hanger pedals, the tail fin assembly will undulate like a fish tail in the body of water to drive the supporting structure forward in the body of water.

While the buoyant underwater viewing device disclosed by Han is suitable for traveling on the upper surface of a body of water and looking into the water, it is unsuitable as a diving device because of its buoyancy and lack of means for initiating dives and ascents in a body of water. It uses hand operated mechanical means to execute turning movements in the plane of the upper surface of the water. It uses adjustable shoulder support pad assemblies to provide the reactive force from the vehicle that allows the vehicle operator to apply force to the pedals with his feet. It furthermore does not provide a means to control the angle of attack of the tail fin with respect to the flow of water past it to prevent stalling that can drastically reduce the propulsive force.

U.S. Pat. No. 5,401,196 to Triantafyllou et al (1995) discloses a propulsion system for use in a fluid, the system utilizing at least one foil which is both oscillated at a frequency f with an amplitude a in a direction substantially transverse to the propulsion direction and flapped or pitched about a pivot point to change the foil pitch angle to the selected direction of motion with a smooth periodic motion. Parameters of the system including Strouhal number, angle of attack, ratio of the distance to the foil pivot point from the leading edge of the foil to the chord length, the ratio of the amplitude of oscillation to the foil chord width and the phase angle between heave and pitch are all selected so as to optimize the drive efficiency of the foil system. Further, while a motor or engine-driven vehicle has been assumed for the preferred embodiment, the invention may also be advantageously utilized in human powered systems with motions of a swimmer's legs being converted by suitable mechanical linkages into heave and pitch motion for one or more foils in accordance with the teachings of this invention. Such devices can provide faster motion with less exertion than currently available systems for propelling a swimmer or diver without a drive motor.

For good performance the marine propulsion system disclosed by Triantafyllou et al requires regulation of a large number of parameters in addition to the angle of attack of a foil with respect to the flow of water past it to prevent stalling. In particular, the dynamic parameter of phase angle between heave and pitch needs to be simultaneously regulated with angle of attack.

BRIEF SUMMARY OF THE INVENTION

A diver lying prone in a body of water grasps the present invention with his hands and pushes on pedals with his feet. The arms of the diver transmit the reactive force from the device that allows the feet of the diver to apply force to the pedals. The pedal motion is converted into propulsive force that moves the diver through the water. The device is configured so that it can be adjusted to divers of varying body dimensions so that a diver is free to bend at his hip joints and bend and twist his spine so as to use his torso as a control foil to cause turns, dives and ascents in the water. The diver can rapidly and easily mount and dismount the device while in the water by grasping or releasing the device with his hands and applying or removing his feet from the pedals. The device is intended to be made with a small positive buoyancy which can be reduced or made negative by addition of weights. The preferred embodiment of the propulsion means comprises a simple direct drive of an arm. As the diver operates the pedals the forward end of the arm pivots with respect to the device as the rearward end of the arm sweeps back and forth in the water. A fin is attached to the rearward end of the arm. The fin is fitted with a simple device for controlling the angle of attack of the fin with respect to the flow of water past it to prevent stalling.

The diver may be equipped with a snorkel, an underwater breathing apparatus; or the diver may free dive without such breathing aides.

The primary object of the present invention is a device wherein means are provided to propel a diver through a body of water with which he is in direct contact that will overcome the shortcomings of the prior art devices. Objects and advantages of the present invention are:

(a) to provide motive power by applying the force of the leg muscles of a diver to pedals.

(b) to provide means for executing dives, ascents and turns in a body of water by using the torso of the body of a diver as a control foil.

(c) to facilitate diving with the device by limiting its buoyancy.

(d) to provide for the transmission of the reactive force of the device that allows a diver to apply force to the pedals by the diver grasping the device with his hands.

(e) to provide, in the preferred embodiment of the means for propulsion, control of the angle of attack of the tail fin with respect to the flow of water past it to prevent stalling without complicated regulation of other parameters.

A further objective is to reduce the complexity of the device so that the device is simple and easy to use, reliable, and economical in cost to manufacture.

Further objects and advantages of the invention will appear from consideration of the ensuing drawings and detailed description.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DETAILED DESCRIPTION OF THE INVENTION

Figure 1:
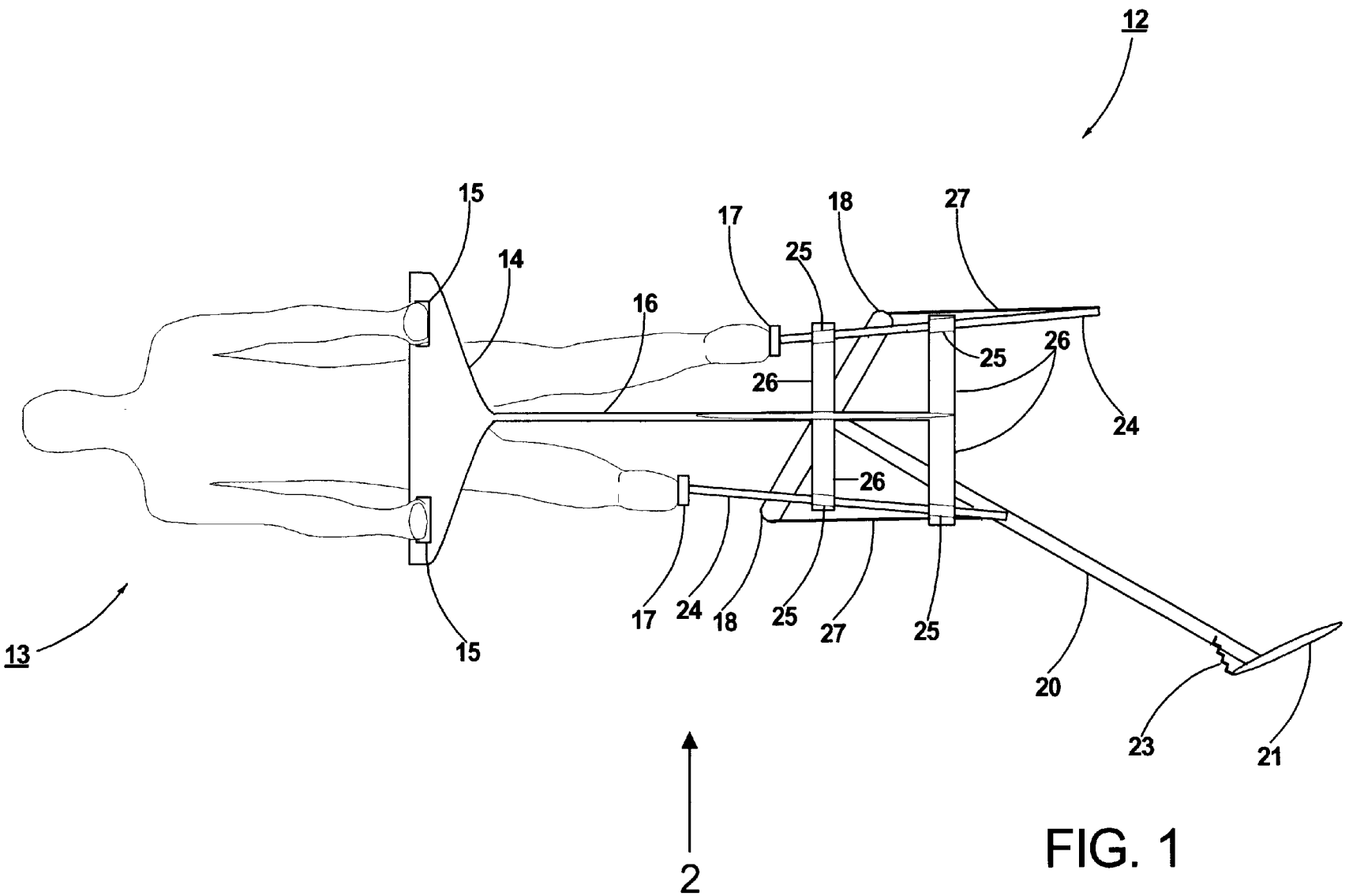
FIG. 1 is a top view of a person positioned in the preferred embodiment of the present invention for operation thereof in accordance with the teachings of this invention.
Figure 2:
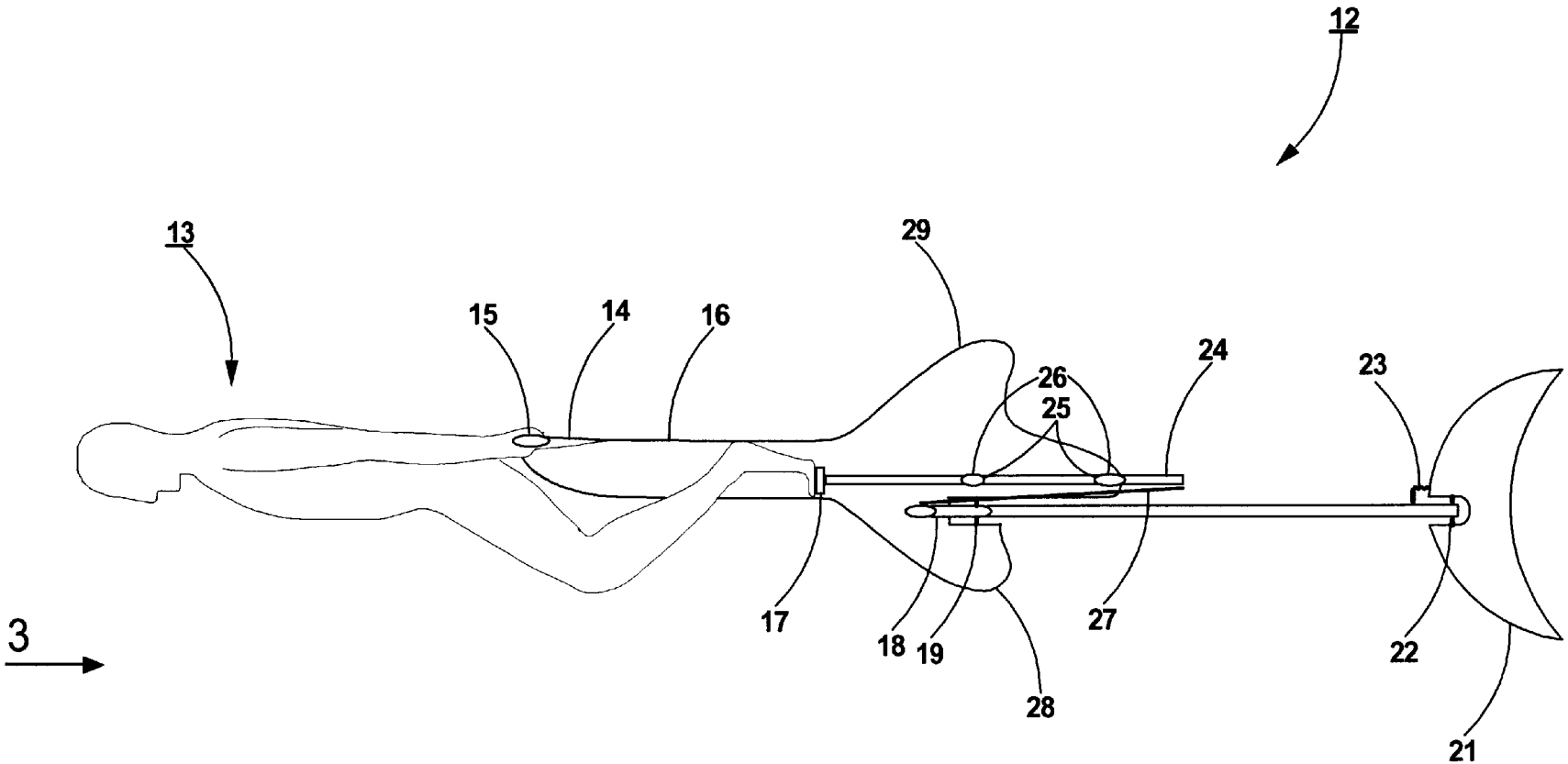
FIG. 2 is a side view taken in the direction of arrow 2 in FIG. 1.
Figure 3:
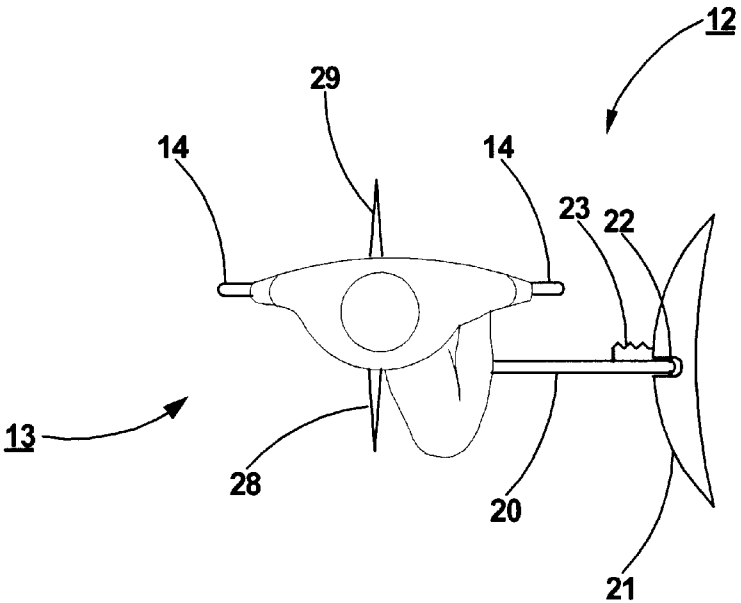
FIG. 3 is a front view taken in the direction of arrow 3 in FIG. 2.

Referring to FIGS. 1–3, a device 12 for propelling a diver 13 through a body of water with which he is in direct contact is shown. The forward part of device 12 is a streamlined strut 14 in which there are a pair of handholds 15 into which diver 13 inserts his hands to grasp device 12. Diver 13 holds strut 14 with straight arms so that its leading edge is rearward of the hip joints of diver 13, which allows diver 13 to bend and twist his torso at his hip joints and along his spine. With forward motion of device 12 and diver 13, bending torso of diver 13 initiates pitch maneuvers that result in dives or ascents in the water. Rotating the spine of diver 13 initiates roll maneuvers that, when subsequently combined with a pitch maneuver, result in a turning in the plane parallel to the water's surface.

A rigid structure 16 connects strut 14 to the means of propelling device 12 and diver 13 through the water. Device 12 and diver 13 are propelled through the water by diver 13 pushing on a pair of pedals 17 located on opposite sides of connecting structure 16. Diver 13 pushes alternately with one foot and then the other on pedals 17. A transmission converts the pedaling motion into back and forth rotation of swivel arm 18 about axle 19. Axle 19 is pivotably mounted to connecting structure 16 so that swivel arm 18 rotates in the plane that contains the hip joints of diver 13. A fin arm 20 is rigidly fixed perpendicular to swivel arm 18 in the plane of rotation of swivel arm 18 and rotates with swivel arm 18. A stiff propulsive fin 21 lying in a plane perpendicular to the plane of rotation of swivel arm 18 and fin arm 20 is pivotably mounted to the rearward end of fin arm 20 by means of axle 22. The axis of axle 22 lies in the plane containing the propulsion fin 21.

Swivel arm 18 is made to measure about 12 to 16 inches from axle 19 to the outside end of swivel arm 18 so that the travel of its outside end is about 16 inches when fin arm 20 rotates from about 45 to 30 degrees on one side of connecting structure 16 to about 45 to 30 degrees on the other side of connecting structure 16. Fin arm 20 is made as long as is consistent with transportation and other operational constraints so as to amplify the back and forth motion of fin 21. The amplification of the back and forth motion of fin 21 both increases the lift force generated by fin 21 and aligns the lift force more closely with the direction of travel of device 12 and diver 13 thereby increasing the propulsive force component of the lift force. The present invention is most comfortably operated where the surface area of fin 22 is made so that the moment about axle 19 generated by the lift force on fin 21 is balanced by the moment exerted by the foot of diver 13 when diver 13 is pushing on a pedal 17 with one foot with a force about equal to the weight of diver 13 when diver 13 is pedaling at a rate of about one pedal stroke per second. This produces an exertion by diver 13 that is similar to the exertion experienced by climbing stairs at the rate of two stairs per second. Faster pedaling results in generation of greater lift force by fin 21 which, by the balance of moments about axle 19, requires greater exertion by diver 13. Slower pedaling results in generation of lesser lift force by fin 21 with consequent lessened exertion by diver 13.

The reactive force that allows diver 13 to exert force on pedals 17 is transmitted through axle 19, connecting structure 16, and strut 14 to the hands and arms of diver 13. When diver 13 is exerting a force about equal to his weight on a pedal 17 with one foot, the tensile force in each arm of diver 13 is about half of the weight of diver 13.

The transmission for converting diver 13 pedaling motion into back and forth rotation of swivel arm 18 and fin arm 20 about axle 19 consists of pedal rods 24 extending rearward from pedals 17. Pedal rods 24 are slidably fitted through holes 25 in a single strut, or as shown, dual struts 26. Struts 26 are rigidly attached to connecting structure 16. Tension lines 27 connect the rear ends of pedal rods 24 to the outside ends of swivel arm 18. When diver 13 pushes one pedal rod 24 rearward by pushing reward the pedal 17 connected to it, the tension line 27 connected to the pedal rod 24 pulls the side of swivel arm 18 that is on the same side of connecting structure 16 rearward. The other end of swivel arm 18 pulls the tension line on the opposite side of connecting structure 16 forward, which also pulls forward the pedal rod 24 on the opposite side and the pedal 17 connected to it.

The length of tension lines 27 are adjusted for proper operation of device 12 as follows: Diver 13 stands on his toes, holds his arms straight down his sides and measures the distance L between the heels of his hands and the floor under his toes. Tension lines 27 are disconnected from pedal rods 24. Fin arm 20 is rotated to one side of connecting structure 16 to the desired maximum angle between fin arm 20 and connecting structure 16, about 30 to 45 degrees. Pedal 17 on the opposite side of connecting structure 16 from fin arm 20 and fin 21 is positioned to be distance L from the leading edge of strut 14. The tension line 27 on the opposite side of connecting structure 16 from fin arm 20 and fin 21 is pulled taut and reconnected to its pedal rod 24. The length D of this reconnected tension line 24 is measured. The length of the other tension line 27 is adjusted to D and it is reconnected to its pedal rod 24. For divers of varying body dimensions, this adjustment procedure positions the leading edge of strut 14 rearward of the hip joints of diver 13 when device 12 is grasped by handholds 15 with the arms of diver 13 held straight down his sides. The adjustment procedure further causes fin arm 20 to reach its maximum angular extension with respect to connecting structure 16 when a leg and the connected foot of diver 13 is fully extended.

Propulsive fin 21 freely rotates about axle 22 to a maximum angle BETA on either side of fin arm 20. Rotation to an angle greater than BETA is constrained by an attack angle controller 23 consisting of a length of line tethering the leading edge of fin 21 to fin arm 20. The length of the attack angle controller 23 tether line is adjusted to constrain BETA. A spring may be inserted in series with the tether line. The length of the attack angle controller 23 tether line may be adjusted to adjust BETA to constrain the average angle of attack of fin 21 with respect to the flow of water past it.

Figure 4:
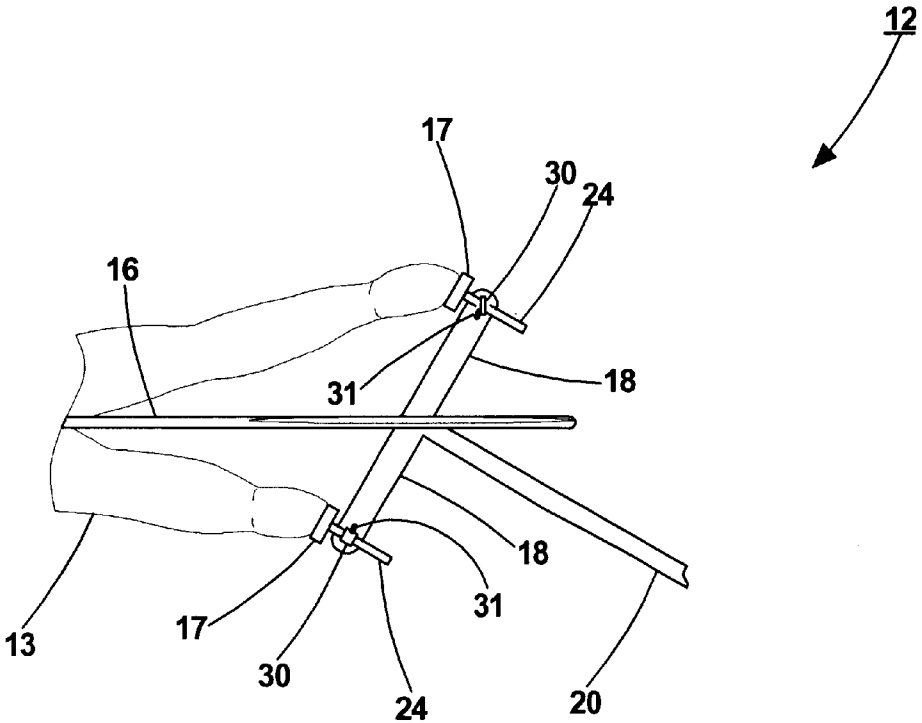
FIG. 4 is a partial top view of the present invention showing the modifications comprising of the invention.
Figure 5:
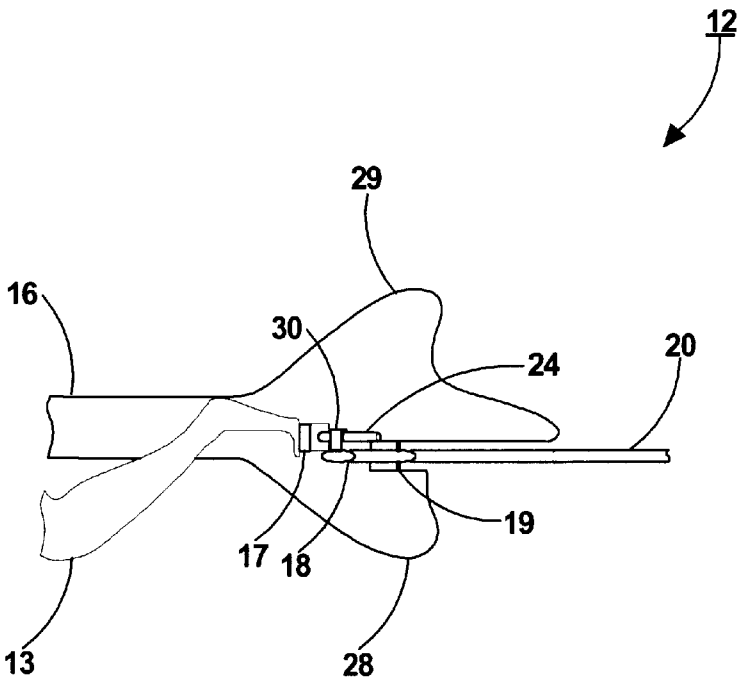
FIG. 5 is a partial side view showing the modifications comprising the modified form of the invention.

Referring to FIGS. 4 and 5, a variation of the transmission for converting diver 13 pedaling motion into back and forth rotation of swivel arm 18 and fin arm 20 about axle 19 consists of replacing tension lines 27 and struts 26 with clamps 30 that are fixed to the outer ends of swivel arm 18. Pedal rods 24 are inserted into clamps 30. The distance S between the pedals 17 and clamps 30 is adjusted for proper operation of device 12 as follows: Distance L between the heels of hands of diver 13 and the floor under his toes is measured as previously described. The clamps grips 31 are loosened. Fin arm 20 is rotated to one side of connecting structure 16 to the desired maximum angle between fin arm 20 and connecting structure 16, about 30 to 45 degrees. Pedal 17 on the opposite side of connecting structure 16 from fin arm 20 and fin 21 is positioned to be distance L from the leading edge of strut 14. The clamp grip 31 on the opposite side of connecting structure 16 from fin arm 20 and fin 21 is tightened to securely grip its pedal rod 24. The distance S along this reclamped pedal rod 24 is measured. The pedal 17 to clamp 30 length along the other pedal rod 24 is adjusted to S and the clamp grip 31 is securely tightened to grip its pedal rod 24. For divers of varying body dimensions, this adjustment procedure positions the leading edge of strut 14 rearward of the hip joints of diver 13 when device 12 is grasped by handholds 15 with the arms of diver 13 held straight down his sides. The adjustment procedure further causes fin arm 20 to reach its maximum angular extension with respect to connecting structure 16 when a leg and foot of diver 13 is fully extended.

Device 12 is easily mounted and dismounted by diver 13 in the water. To mount device 12, diver 13 simply grasps strut 14 with handholds 15 and applies his feet to pedals 17. To dismount, diver 13 simply removes his feet from pedals 17 and releases his grip of strut 14.

In addition to the roll followed by a pitch maneuver previously described, turns in the plane parallel to the surface of the body of water wherein the device 12 and diver 13 are located can be accomplished by more forcefully pushing the pedal 17 on the outside of the turn than the pedal 17 on the inside of the turn The preferred embodiment of device 12 is to manufacture it from materials so that it is slightly positively buoyant. Weights can be affixed to device 12 to reduce or make negative its buoyancy to suit the purposes for which it is to be used.

Ventral 28 and/or dorsal 29 stabilizing fins lying in a plane perpendicular to the plane of rotation of the swivel arm 18 and fin arm 20 may be affixed to connecting structure 16 near axle 19 to resist sideways motion.

A variation of the embodiment of rigid connecting structure 16 together with any stabilizing fins 28 and/or 29 affixed to it consists of a free flooding hallow storage compartment with removable access panels for accessing the storage compartment. The storage compartment may be used by diver 13 to carry tools to an activity site which may include a tether for tethering device 12 near the activity site and/or swim fins to be used for better maneuverability of diver 13 when he has dismounted device 12.

The preferred embodiment of fin 21, axle 22 and attack angle controller 23 allows fin 21 to be detached from axle 22 and attack angle controller 23 and replaced by an alternatively sized and shaped fin.

Other variations in the details of construction for the device 12 are also possible. Thus, while the invention has been shown and described above with reference to a preferred embodiment, and a number of variations on the preferred embodiment have been discussed, it should be understood that what has been discussed above is for purposes of illustration only, and that the foregoing and other changes in form in detail may be made in the invention by one skilled in the art without departing from the spirit and scope of the invention which is to be defined only by the following claims.

I claim:

1. A device for propelling a diver through a body of water with which he is in direct contact using pedal movements of his feet; which device also allows the diver to perform diving, ascending and turning maneuvers with the device by bending and twisting his torso; and furthermore allows the diver to mount the device in the water by simply grasping the device with his hands and applying his feet to the pedals and allows the diver to dismount the device in the water by simply removing his feet from the pedals and releasing his grip on the device; compromising:

a) a handhold structure in which there are one or more handholds for grasping by the diver;

b) a rigid connecting structure connected to the handhold structure and extending rearward from it;

c) a pair of pedals located on opposite sides of said rigid connecting structure that the diver pushes alternately with one foot and then the other;

d) a swivel arm pivotably affixed to said rigid connecting structure so that the swivel arm rotates in a plane parallel to the hip joints of the diver;

e) pedal rods extending rearward from the pedals, wherein said pedal rods are slidably fitted through holes in one or more struts that are attached to said rigid connecting structure;

f) tension lines that connect the rear ends of the pedal rods to the outside ends of the swivel arm on the same side of the rigid connecting structure as the pedal rod so that the swivel arm is rotated when the diver pushes on a pedal, wherein said tension lines include:

i) means for being shortened or lengthened to adjust the position of the pedals so that the handhold structure is rearward of the diver's hip joints when he is operating the pedals with his feet; and e) a fin arm fixed perpendicular to the swivel arm in the plane of rotation of the swivel arm that rotates with the swivel arm;

f) a propulsive fin, wherein said propulsive fin includes:

i) being disposed so that the fin is contained in a plane perpendicular to the plane of rotation of the swivel arm and fin arm; and ii) being pivotably affixed to the rearward end of the fin arm; and g) means for controlling the angle of attack of the propulsion fin with respect to the flow of water past it to prevent stalling.

2. A device for propelling a diver through a body of water with which he is in direct contact using pedal movements of his feet; which device also allows the diver to perform diving, ascending and turning maneuvers with the device by bending and twisting his torso; and furthermore allows the diver to mount the device in the water by simply grasping the device with his hands and applying his feet to the pedals and allows the diver to dismount the device in the water by simply removing his feet from the pedals and releasing his grip on the device; compromising:

a) a handhold structure in which there are one or more handholds for grasping by the diver;

b) a rigid connecting structure connected to the handhold structure and extending rearward from it;

c) a pair of pedals located on opposite sides of said rigid connecting structure that the diver pushes alternately with one foot and then the other;

d) a swivel arm pivotably affixed to said rigid connecting structure so that the swivel arm rotates in a plane parallel to the hip joints of the diver;

e) pedal rods extending rearward from the pedals that are grasped by clamps, wherein said clamps include:

i) attachment to the outside ends of the swivel arm so that the swivel arm is rotated when the diver pushes on a pedal; and ii) means for loosening and tightening said clamps so that the position of the pedals can be adjusted so that the handhold structure is positioned rearward of the diver's hip joints when he is operating the pedals with his feet; and e) a fin arm fixed perpendicular to the swivel arm in the plane of rotation of the swivel arm that rotates with the swivel arm;

f) a propulsive fin, wherein said propulsive fin includes:

i) being disposed so that the fin is contained in a plane perpendicular to the plane of rotation of the swivel arm and fin arm; and ii) being pivotably affixed to the rearward end of the fin arm; and g) means for controlling the angle of attack of the propulsion fin with respect to the flow of water past it to prevent stalling.

3. A device for propelling a diver through a body of water with which he is in direct contact using pedal movements of his feet; which device also allows the diver to perform diving, ascending and turning maneuvers with the device by bending at the hip joints and twisting his entire torso; and furthermore is disposed so that the only contact between the diver and the device that is required to operate the device is by the hands of the diver grasping the device and by the undersides of the feet of the diver being applied to the device; comprising:

a) a handhold structure in which there are one or more handholds for grasping by the diver; wherein said handhold structure:

i) is arranged to be disposed on the posterior side of the diver; and ii) is the forward most extent of the device; and b) means for propelling the device through a body of water using pedals that are operated by the feet of the diver; and c) a rigid structure connecting the handhold structure to the means for propelling the device through a body of water using pedal movements of the feet of the diver, wherein said rigid structure:

i) extends rearward from the handhold structure, and ii) is of a length that positions the handhold structure rearward of the hip joints of the diver when he is pedaling with his feet.

* * * * *